United States Patent [19]

Kenmochi et al.

[11] Patent Number: 4,769,178

[45] Date of Patent: Sep. 6, 1988

[54] COLD-ROLLING LUBE OIL FOR METALLIC MATERIALS

[75] Inventors: Kazuhito Kenmochi; Hideo Abe; Toru Sasaki; Koichi Ito; Takeshi Yoshimoto, all of Chiba; Hiroyuki Nagamori, Wakayama; Hiroyuki Matsuda, Kainan, all of Japan

[73] Assignees: Kao Corporation, Tokyo; Kawasaki Steel Corporation, Kobe, both of Japan

[21] Appl. No.: 839,992

[22] Filed: Mar. 17, 1986

[30] Foreign Application Priority Data

Mar. 19, 1985 [JP] Japan ..... 60-55181

[51] Int. Cl.[4] ..... C10M 105/34; C10M 173/00

[52] U.S. Cl. ..... 252/56 S; 252/56 R; 252/49.5; 252/45; 72/41

[58] Field of Search ..... 252/56 S, 56 R, 49.5; 72/41

[56] References Cited

U.S. PATENT DOCUMENTS

| | | | |
|---|---|---|---|
| 3,945,930 | 3/1976 | Sugiyama et al. | 252/56 S |
| 4,036,769 | 7/1977 | Zipf | 252/56 S |
| 4,062,784 | 12/1977 | Bauer | 252/56 R |
| 4,096,078 | 6/1978 | Yaffee | 252/56 S |
| 4,116,872 | 9/1978 | Jahnke | 252/56 S |
| 4,178,260 | 12/1979 | Cook et al. | 252/56 S |
| 4,191,658 | 3/1980 | Jahnke | 252/56 S |
| 4,191,801 | 3/1980 | Jahnke | 252/56 S |
| 4,292,187 | 9/1981 | Hentschel et al. | 252/56 S |
| 4,559,153 | 12/1985 | Baldwin et al. | 252/56 R |
| 4,566,983 | 1/1986 | Hayashi | 252/56 R |
| 4,578,202 | 3/1986 | Urban et al. | 252/56 S |
| 4,585,564 | 4/1986 | Tohmata et al. | 252/56 R |

*Primary Examiner*—William R. Dixon, Jr.
*Assistant Examiner*—Jerry D. Johnson
*Attorney, Agent, or Firm*—Oblon, Fisher, Spivak, McClelland & Maier

[57] ABSTRACT

A cold-rolling lube oil for metallic materials is composed of (a) 40–90 wt. % of a monoester of a specific aliphatic carboxylic acid and a particular aliphatic alcohol, (b) 0.5–10 wt. % of at least one of dimer acids and polymer acids of certain unsaturated higher fatty acids, (c) 10–25 wt. % of a fats and fatty oils, or 5–70 wt. % of an ester obtained by reacting remaining carboxyl or hydroxyl groups of a specific polyester with a specific alcohol or fatty acid, (d) 0.3–10 wt. % of a phenol-type antioxidant, and (e) 0.3–10 wt. % of a sulfur-type antioxidant.

11 Claims, No Drawings

COLD-ROLLING LUBE OIL FOR METALLIC MATERIALS

BACKGROUND OF THE INVENTION (i) Field of the Invention

This invention relates to a novel cold-rolling lube oil (which may hereinafter be called "rolling mill oil" for the sake of brevity) for metallic materials, and more specifically to a cold-rolling lube oil for metallic materials, which exhibits good lubricity and surface cleaness and excellent heat-resistant and oxidation-resistant stability upon rolling metallic materials.

(ii) Description of the Prior Art

In recent years, there is a tendency to use a mill-cleaning rolling mill oil in order to omit the cleaning step in cold rolling. The following two properties may be mentioned as critical for such a mill-cleaning rolling mill oil:

(i) The surface of each plate can be kept free from stains by the carbon component of the rolling mill oil upon its annealing, thereby providing beautiful surface quality (this property will hereinafter be called "annealing stain resistance" or "mill-cleaning property"); and (ii) The rolling mill oil is supposed to show good lubricity upon rolling and not to develop galling called "heat streak" or vibrations called "chattering" (this property will hereinafter be called "lubricity").

In order to improve the mill-cleaning property (i), it is currently practiced to use such rolling mill oils that have been obtained by reducing the contents of fatty acids, fatty oils, fats and/or high-molecular organic compounds, which tend to lead abundant residual carbon components upon annealing, as much as possible and instead incorporating volatile or readily-decomposable materials such as mineral oils and synthetic esters as principal ingredients.

However, such rolling mill oils have poor adherence to materials, show weak oil-film forming properties in roll contact arcs and as a matter of fact, have inferior lubricity. An attempt for improvement to the lubricity (ii) will result in use of a fatty oil, fat or fatty acid at a high content such as beef tallow base rolling mill oil, leading to a reduction to the mill-cleaning property.

A mill-cleaning rolling mill oil, which is employed to omit the cleaning step, is hence required to have these mutually-contradictory two properties. Accordingly, mill-cleaning rolling mill oils which have been put into practical use to date are applied only to sheet gage materials which have relatively great finished plate thicknesses and permit use of mild rolling conditions (for example, those having finished plate thicknesses of 0.8 mm and greater).

With the foregoing in view, the present inventors carried out an extensive research to provide a cold-rolling lube oil equipped with both of the above-described properties. As a result, it was found that a composition obtained by mixing a specific amount of a monoester obtained from an aliphatic carboxylic acid and an aliphatic alcohol, a prescribed amount of a dimer acid or polymer acid and a predetermined amount of an ester obtained by reacting remaining carboxyl or hydroxyl groups of a polyester, which had in turn been obtained by heating and condensing at least one of dimer acids and/or polymer acids of unsaturated higher fatty acids with a polyol, with an alcohol or fatty acid did not develop oil stain and had excellent mill-cleaning property and good lubricity, on which a patent application has already been made (now, Japanese Patent Laid-Open No. 33395/1984).

Reflecting rapid advancement in rolling mills and rolling technology in recent years, the rolling speed has been increased to achieve mass production. Coupled with such advancement, severer requirements have been imposed on cold-rolling lube oils. Under the circumstances, conventional cold-rolling lube oils cannot fully meet such requirements. Conventional cold-rolling lube oils were however accompanied by one or more problems. Namely, such conventional cold-rolling lube oils are subject to thermal decomposition and thermal oxidative decomposition and are thus deteriorated during their applications in coolants under severe conditions to which they are believed to be exposed during actual cold rolling. Further, iron powder, scum and the like are formed during rolling work. These stain-forming impurities are then caused to mix in the lube oils. When rolled steel coils are subjected to subsequent steps with these stain-forming impurities still adhered together with the lube oils on the surfaces of the coils, the lube oils are polymerized and resinified and are thus rendered hard to evaporate due to chemical reactions such as oxidation, decomposition and polymerization under such conditions as mentioned above even if the lube oils are inherently supposed to evaporate substantially in their entirety by remaining heat of about 130° C. or so and their heating to 200°-300° C. upon annealing. When the coils are then subjected to the subsequent annealing step, the lube oils are carbonized due to intensive heat (300°-700° C.), and stains of soot are formed on the entire surfaces of the steel sheets and soot is caused to stick on edge portions of the rolled steel sheets to develop such a state as the so-called "edge carbon" which causes poor appearance. Moreover, the abovementioned resinified lube oils impair the easiness of surface treatments such as platability, bonderizability, paintability, etc.

SUMMARY OF THE INVENTION

The present inventors then proceeded with a further research under the above-described circumstances, resulting in a finding of a cold-rolling lube oil for metallic materials, which can maintain good resistance to thermal decomposition and thermal oxidative decomposition even under severe conditions expected to encounter in actual operations, namely, even when recycled and used as a rolling mill oil, i.e., rolling mill coolant over a long period of time, can maintain the surface cleaness of a steel sheet satisfactorily until completion of its annealing even when stain-forming impurities such as iron powder and scrum, which are produced upon rolling, are mixed in, and is also excellent in lubricity.

The present invention is now described in more detail. A cold-rolling lube oil for metallic materials, which cannot satisfy the above conditions (i) and (ii), may in some instances result in the formation of soot stains all over the surfaces of a steel sheet and the development of a state such as "edge carbon", in which soot has been caused to stick on edge portions of the steel sheet, after its annealing. Moreover, the easiness of surface treatments such as platability, bonderizability and paintability may also be deleteriously affected. It has however been found that the surface cleaness of a steel sheet can be maintained satisfactorily until completion of its annealing by combining specific sorts of antioxidants with a lube oil composition which is formed of a fatty acid monoester, a dimer acid and/or polymer acid of an unsaturated fatty acid, and a fats and fatty oils or a specific ester, leading to completion of this invention.

Namely, this invention provides a cold-rolling lube oil for metallic materials, comprising:

(a) 40–90 wt. % of a monoester of an aliphatic carboxylic acid having 12–22 carbon atoms and an aliphatic alcohol having 1–12 carbon atoms;

(b) 0.5–10 wt. % of at least one of dimer acids and polymer acids of unsaturated higher fatty acids having 16–20 carbon atoms;

(c) 10–25 wt. % of a fats and fatty oils, or 5–70 wt. % of an ester having a molecular weight of 750–7500 and obtained by reacting remaining carboxyl or hydroxyl groups of a polyester, which has in turn been obtained by heating and condensing at least one of dimer acids and polymer acids of an unsaturated higher fatty acids having 16–20 carbon atoms and a polyol, with an alcohol having 1–22 carbon atoms or a fatty acid having 12–22 carbon atoms;

(d) 0.3–10 wt. % of a phenol-type antioxidant; and (e) 0.3–10 wt. % of a sulfur-type antioxidant.

As has been described above, the cold-rolling lube oil of this invention makes use of a composition, which has been formed of the compounds (a), (b) and (c) and has excellent lubricity and mill-cleaning property, as a base oil, with which the phenol-type antioxidant and sulfur-type antioxidant are combined as antioxidants. It has brought about excellent lubricity along with superb annealing property.

Compared with conventional products, the cold-rolling lube oil of this invention has various advantages. The lubricity of the cold-rolling lube oil of this invention is either equal to or better than those of conventional and commercial beef tallow rolling mill oils and its mill-cleaning property is either equal to or better than those of conventional and commercial rolling mill oils of the mineral oil type. Furthermore, it also permits mill clean rolling even to thin materials although the application of mill clean rolling has conventionally been limited only to thick or medium-thickness materials.

The above and other objects, features and advantages of the present invention will become apparent from the following description and the appended claim.

DETAILED DESCRIPTION OF THE INVENTION AND PREFERRED EMBODIMENTS

The monoester (a) useful as a base oil component in the present invention is a monoester of an aliphatic carboxylic acid having 12–22 carbon atoms and an aliphatic alcohol having 1–12 carbon atoms. As typical examples of such a monoester, may be mentioned methyl stearate, methyl behenate, butyl stearate, octyl stearate, lauryl stearate, methyl oleate, octyl oleate, decyl oleate, lauryl oleate, methyl palmitate, butyl palmitate, the methyl ester of beef tallow fatty acid, the octyl ester of beef tallow fatty acid, the lauryl ester of beef tallow fatty acid, the methyl ester of palm kernel oil fatty acid, the octyl ester of palm kernel oil fatty acid, the octyl ester of coconut oil fatty acid, the lauryl ester of coconut oil fatty acid, and so on. These esters have mill-cleaning properties and lubricity better than mineral oils which are usually employed as base oils in mill-cleaning rolling mill oils.

If the aliphatic carboxylic acid employed in the ester should have more than 22 carbon atoms or the aliphatic alcohol, also employed in the ester, should contain more than 12 carbon atoms, more oil stains will be formed. If the carbon number of the aliphatic carboxylic acid should be fewer than 12 on the other hand, the lubricity will be reduced. The above ester is used in an amount of 40–90 wt. % (hereinafter described merely as "%") of the whole composition. If its content should exceed 90%, the contents of the dimer acid or polymer acid (b) and fats and fatty oils or ester (c) will be lowered, leading to a reduction to the lubricity. On the other hand, any monoester contents smaller than 40% will result in a reduction to the contribution of the monoester in the base oil for the lowered oil-staining tendency, thereby making it difficult to draw out the effects of the monoester for the improvement of the mill-cleaning property. It is therefore not preferred to use the monoester in any amounts outside the above-described range.

In the present invention, it is necessary to add the dimer acid and/or polymer acid (b) and furthermore, the fats and fatty oils or ester (c) to the above-described ester so as to prepare a base oil for use in this invention. A rolling mill oil making use of such a base oil has lubricity either equal to or better than usual beef tallow base rolling mill oils. In addition, it shows such a characteristic property that even when it sticks and remains on the surfaces of a rolled steel sheet, it does not develop oil stains upon subsequent annealing and hence makes it possible even to bring about a further positive improvement to the lubricity.

The dimer acid or polymer acid (b) is a dimer acid or polymer acid of a higher aliphatic monoene or diene acid having 16–20 carbon atoms. As illustrative examples of the dimer acid or polymer acid (b), may be mentioned a dimer acid or polymer acid of zoomaric acid, oleic acid, linoleic acid and gadoleic acid. The dimer acid or polymer acid may be used in an amount of 0.5–10% of the whole composition. If it should be used in any amounts greater than the upper limit, occurrence of oil stains will become remarkable. However, any amounts lower than the lower limit will result in reduced lubricity. It is therefore not preferable to use the dimer or polymer acid in any amounts outside the above range.

As the fats and fatty oils (c), may for example be mentioned beef tallow, palm kernel oil, hog fat or the like. Crude beef tallow, purified beef tallow and edible beef tallow can all be used as beef tallow. It is however desirable to use purified or edible beef tallow. As palm kernel oil, crude palm kernel oil, purified palm kernel oil and deacidified palm kernel oil can all be employed with use of purified palm kernel oil and deacidified palm kernel oil being desirable. Purified hog fat is desirable as hog fat. The fats and fatty oils is used in an amount of 10–25% of the whole composition. If its content should exceed 25%, occurrence of oil stains will become remarkable. On the other hand, any amounts lower than 10% will lead to reduced lubricity. It is therefore not preferable to use the fats and fatty oils in any amounts outside the above range.

The ester (c) which may be used as an alternative for the fats and fatty oils is an ester having a molecular weight of 750–7500 and obtained by heating and condensing at least one of dimer acids or polymer acids of unsaturated higher fatty acids having 16–20 carbon atoms and a polyol to form a polyester and then reacting remaining carboxyl or hydroxyl groups of the polyester with an alcohol having 1–22 carbon atoms or a fatty acid having 12–22 carbon atoms.

The dimer acid or polymer acid useful in the above-described formation of the polyester is identical to the dimer acid or polymer acid employed above as the ingredient (b). Illustrative of the polyol may include propylene glycol, ethylene glycol, dipropylene glycol, diethylene glycol, neopentyl glycol, butane diol, pentane diol and hexane diol and besides, polyoxypropylene glycol, polyoxyethylene glycol, polyoxypropylene-polyoxyethylene-glycol and the like. As the alcohol having 1–22 carbon atoms, may for example be mentioned methanol, ethanol, butanol, heptyl alcohol, octyl alcohol, capryl alcohol, nonyl alcohol, decyl alcohol, stearyl alcohol, undecyl alcohol, lauryl alcohol, myristyl alcohol, palmityl alcohol, isostearyl alcohol, behenyl alcohol, oleyl alcohol or the like. On the other hand, illustrative of the fatty acid having 12–22 carbon atoms may include lauric acid, myristic acid, palmitic acid, stearic acid, isostearic acid, oleic acid, behenic acid and the like.

If the molecular weight of the ester (c) should be smaller than 750, the lubricity will be lowered. If the molecular weight should be greater than 7,500, the solubility of the ester in the mixing system will be reduced and its viscosity will be increased. This will also cause some problems upon handling the same. It is therefore not preferable for the ester to have such a small or great molecular weight. The ester (c) is used in an amount of 5–40% of the whole composition. If its content should exceed 40%, occurrence of oil stains will become remarkable. If its content should be smaller than 5%, the lubricity will be lowered. It is hence not preferable to use the ester in any amounts outside the above-described range.

As the phenol-type antioxidant (d), may be employed 2,6-di-tert-butyl-p-cresol, 2-tert-butyl-p-cresol, 2,6-di-tert-butylphenol, 3-methyl-6-tert-butylphenol, 2,4-di-tert-butylphenol, 2,5-di-tert-butyl-p-cresol, 3,5-di-tert-butyl-4-hydroxybenzylalcohol, 2,4,6-tri-tert-butylphenol, catechol, p-tert-butyl-catechol, 4,6-di-tert-butyl-resorcin, 6-(4-oxy)-3,5-di-tert-butyl-anilino-2,4-bis-(n-octylthio)-1,3,5-triazine, (4-oxy-3,5-di-tert-butylbenzyl)-octadecyl phosphate, 4,4'-thiobis(3-methyl-6-tert-butylphenol), 4,4'-butylidenebis-(3-methyl-6-tert-butylphenol), 2,2'-methylenebis(4-methyl-6-tert-butylphenol), 2,2'-thiobis(4,6-di-tert-butylresorcine), 2,2'-methylenebis(4-ethyl-6-tert-butylphenol), 4,4'-methylenebis(2,6-di-tert-butylphenol), 2,2'-(3,5-di-tert-butyl-4-hydroxy)propane, 4,4'-cyclohexylidenebis(2,6-di-tert-butylphenol), tetrakis[methylene-3-(3,5-di-tert-butyl-4-hydroxyphenyl)propionate]methane, hexamethyleneglycolbis[$\beta$-(3,5-di-tert-butyl-4-hydroxyphenol)propionate], 2,2'-thio[diethyl-bis-3-(3,5-di-tert-butyl-4-hydroxyphenol)propionate], 1,3,5-trimethyl-2,4,6-tris(3,5-di-tert-butyl-4hydroxybenzyl)benzene, glycol bis-[3,3'-bis-(4'-hydroxy-3'-tert-butyl-phenyl)-butyrate], 1,3,5-tris-(4-tert-butyl-3-hydroxy-2,6-dimethylbenzyl)isocyanuric acid, etc. They may be used either singly or in combination.

As illustrative examples of the sulfur-type antioxidant (e), may be mentioned dilauryl thiodipropionate, dimyristyl thiodipropionate, distearyl thiodipropionate, laurylstearyl thiodipropionate, distearyl $\beta,\beta'$-thiodibutylate, dilauryl sulfide, dioctadecyl sulfide, 2-mercaptobenzoimidazole, s-(3,5-di-tert-butyl-4-hydroxybenzyl) alkylthioglycolates, 4,4'-thiobis-(6-alkyl-3-methylphenols), N-oxy-diethylenebenzothiazylsulfenamide, tetraalkylthiuram disulfide, tetraalkylthiuram monosulfide, and so on. They may be used either singly or in combination.

The phenol-type antioxidant (d) is used in an amount of 0.3–10.0% based on the whole composition while the sulfur-type antioxidant (e) is employed in an amount of 0.3–10.0% based on the whole composition. If their contents should exceed 10.0%, adverse effects will be given to the lubricity. If their contents should be lower than 0.3% on the other hand, their plate surface cleaning effects will not be drawn out fully. It is therefore not preferable to use the antioxidants in any amounts outside the above-specified corresponding ranges.

The cold-working lube oil of this invention may also contain, besides the above-described essential ingredients, conventionally-known various additives as needed, for example, surfactant, rust preventive, extreme-pressure additive and/or the like.

As the surfactant, may for example be employed a non-ionic surfactant such as polyoxyethylene alkylphenyl ether, polyoxyethylene alkyl ether, polyoxyethylene alkyl ester polyoxyethylene polyoxypropylene ether or alkyl ester of sorbitan, a phosphoric ester type surfactant such as alkyl phosphate, polyoxyethylenealkyl phosphate, or the like. Usually, about 0.5–5% of the surfactant may be added to the cold-rolling lube oil.

As the rust preventive, may for example be used an amine or its derivative, an alkenylsuccinic acid or its derivative, a phosphoric ester or its derivative, or the like. It may generally be incorporated in an amount of about 0.1–5% or so in the cold-rolling lube oil.

As the extreme-pressure additive, may for example be used a phosphorus compound such as trialkyl phosphate or trialkyl phosphite, or an organometallic compound such as zinc dialkylthiophosphate. The extreme-pressure additive may be incorporated in an amount of about 0.5–5% or so in the cold-rolling lube oil.

Although the mechanism of effects that excellent sheet surface cleaness can be obtained even under severe conditions in an actual operation owing to the combination of the lube oil composition of the ingredients (a), (b) and (c) with the phenol-type antioxidant (d) and the sulfur-type antioxidant (e) in the cold-rolling lube oil of this invention has not been fully elucidated, the phenol-type antioxidant (d) appears to prevent the rolling mill oil composition from tending to be polymerized and resinified due to chemical reactions such as its thermal decomposition and thermal oxidative decomposition upon its use in a coolant and its oxidative decomposition polymerization on the surfaces of steel sheets after their rolling, thereby serving primarily to suppress occurrence of soot stains on the entire surfaces of steel plates upon their annealing. On the other hand, the sulfur-type antioxidant (e) seems to give synergistic assistance to the effects of the phenol-type antioxidant. Owing to the function of the sulfur-type antioxidant (e) as a negative catalyst against metals which function is inherent to sulfur compounds, it is also believed to suppress the carbonization reaction, which takes place upon decomposition of the lube oil, and hence to reduce occurrence of soot and at the same time, to inactivate the surfaces of steel sheets so as to prevent adherence of soot, which has been produced through the carbonization reaction of organic compounds contained in the gaseous annealing atmosphere, to edge portions of rolled sheets and hence to reduce occurrence of such a state as edge carbon. The sheet surface cleaness is believed to have been materialized for the first time owing to the combined use of both antioxidants.

Having generally described the invention, a more complete understanding can be obtained by reference to certain specific examples, which are provided herein for purposes of illustration only and are not intended to be limiting unless otherwise specified.

EXAMPLES

This invention will hereinafter be described by the following Examples.

EXAMPLE 1:

The following tests were conducted on various rolling mill oils the compositions of which will be described below. Results are shown in Table 1 and Table 2.

I. Rolling mill oils (proportions are all by wt. % in each composition).

| (1) Rolling mill oils of this invention: | |
|---|---|
| No. 1 | |
| 2-Ethylhexyl stearate | 71 |
| Polymer acid (1) | 1 |
| Purified beef tallow | 20 |
| Phenol-type antioxidant (A) | 2 |
| Sulfur-type antioxidant (B) | 2 |
| Surfactant (a) | 3 |
| Extreme-pressure additive of the phosphoric ester type | 1 |
| No. 2 | |
| Methyl ester of beef tallow fatty acid | 59 |
| Polymer acid (2) | 5 |
| Deacidified palm kernel oil | 15 |
| Phenol-type antioxidant (B) | 1 |
| Phenol-type antioxidant (C) | 1 |
| Sulfur-type antioxidant (A) | 3 |
| Mineral oil | 10 |
| Surfactant (b) | 5 |
| Extreme-pressure additive of the phosphoric ester type | 1 |
| No. 3 | |
| Butyl stearate | 75 |
| Polymer acid (3) | 8 |
| Ester (A) | 10 |
| Phenol-type antioxidant (D) | 0.5 |
| Sulfur-type antioxidant (A) | 0.5 |
| Sulfur-type antioxidant (C) | 2.0 |
| Surfactant (c) | 3 |
| Extreme-pressure additive of the phosphoric ester type | 1 |
| No. 4 | |
| n-Octyl palmitate | 63 |
| Polymer acid (4) | 1 |
| Ester (B) | 30 |
| Phenol-type antioxidant (A) | 0.5 |
| Phenol-type antioxidant (D) | 2.0 |
| Sulfur-type antioxidant (D) | 0.5 |
| Surfactant (b) | 3 |
| No. 5 | |
| Ethyl ester of palm kernel oil fatty acid | 72 |
| Polymer acid (5) | 4 |
| Ester (C) | 15 |
| Phenol-type antioxidant (A) | 1 |
| Sulfur-type antioxidant (A) | 4 |
| Surfactant (b) | 3 |
| Extreme-pressure additive of the phosphoric ester type | 1 |

| (2) Comparative rolling mill oils: | |
|---|---|
| No. 1 | |
| Methyl ester of palm kernel oil fatty acid | 90 |
| Polymer acid (4) | 1 |
| Purified beef tallow | 1 |
| Phenol-type antioxidant (A) | 2 |

-continued

| (2) Comparative rolling mill oils: | |
|---|---|
| Surfactant (a) | 5 |
| Extreme-pressure additive of the phosphoric ester type | 1 |
| No. 2 | |
| Butyl stearate | 87.2 |
| Polymer acid (1) | 0.3 |
| Ester (A) | 5 |
| Sulfur-type antioxidant (B) | 1.5 |
| Surfactant (b) | 5 |
| Extreme-pressure additive of the phosphoric ester type | 1 |
| No. 3 | |
| Methyl ester of beef tallow fatty acid | 74.8 |
| Purified beef tallow | 20 |
| Polymer acid (1) | 2 |
| Phenol-type antioxidant (A) | 0.1 |
| Sulfur-type antioxidant (C) | 0.1 |
| Surfactant (a) | 3 |
| No. 4 | |
| Propyl stearate | 72.5 |
| Ester (A) | 20 |
| Beef tallow fatty acid | 2 |
| Phenol-type antioxidant (B) | 1.5 |
| Surfactant (a) | 3 |
| Extreme-pressure additive of the phosphoric ester type | 1 |
| No. 5 | |
| Ethyl ester of palm kernel oil fatty acid | 75 |
| Polymer acid (5) | 4 |
| Ester (C) | 15 |
| Surfactant (b) | 5 |
| Extreme-pressure additive of the phosphoric ester type | 1 |
| No. 6 | |
| Commercial rolling mill oil of the beef tallow type | |
| No. 7 | |
| Commercial rolling mill oil of the mineral oil type | |

In the above compositions, the polymer acids, esters, antioxidants, surfactants and extreme-pressure additive mean as follows:

Polymer acid (1) . . . Polymer acid obtained from a 1:2 mixture of oleic acid and linoleic acid (dimer acid/-polymer acids above trimer acid =2/8).

Polymer acid (2) . . . Polymer acid obtained from tall oil fatty acid (dimer acid/polymer acids above trimer acid =6/4).

Polymer acid (3) . . . Polymer acid obtained from soybean oil fatty acid (dimer acid/polymer acids above trimer acid =4/6).

Polymer acid (4) . . . Polymer acid obtained from oleic acid (dimer acid/polymer acids above trimer acid =8/2).

Polymer acid (5) . . . Polymer acid obtained from a 1:1 mixture of oleic acid and zoomaric acid (dimer acid/-polymer acids above trimer acid =7/3).

Ester (A) . . . Ester (hydroxyl number: 6; acid value: 9; average molecular weight: 1,800) obtained by heating and condensing, in a nitrogen gas stream and at normal pressure and 220° C., a mixture consisting of 100 g of a polyol polyester (hydroxyl number: 70), which had been obtained by heating and condensing a mixture of 100 g polymer acid (2) and 24 g diethylene glycol at normal pressure and 220° C. in a nitrogen gas stream, and 32 g of stearic acid (acid value: 204).

Ester (B) . . . Ester (hydroxyl number: 9; acid value: 6; average molecular weight: 1,300) obtained by heating and condensing, in a nitrogen gas stream and at normal pressure and 220° C., a mixture consisting of 100 g of a polyol polyester (hydroxyl number: 114), which had been obtained by heating and condensing a mixture of 100 g polymer acid (2) and 23 g propylene glycol at normal pressure and 220° C. in a nitrogen gas stream, and 29 g of behenic acid (acid value: 161).

Ester (C) . . . Ester (hydroxyl number: 5; acid value: 4; average molecular weight: 4,500) obtained by heating and condensing, in a nitrogen gas stream and at normal pressure and 220° C., a mixture consisting of 100 g of a polyol polyester (hydroxyl number: 2.5), which had been obtained by heating and condensing a mixture of 100 g polymer acid (4), 5 g neopentyl glycol and 17 g diethylene glycol at normal pressure and 220° C. in a nitrogen gas stream, and 9 g of palmitic acid (acid value: 256).

Phenol-type antioxidant (A) . . . 2,5-Di-tert-butyl-p-cresol.

Phenol-type antioxidant (B) . . . 4,4'-Butylidenebis(3-methyl-6-tert-butylphenol).

Phenol-type antioxidant (C) . . . Tetrakis[methylene-3-(3,5-di-tert-butyl-4-hydroxyphenyl)propionate] methane.

Phenol-type antioxidant (D) . . . Glycol bis-[3,3'-bis-(4'-hydroxy-3'-tert-butylphenyl)-butyrate].

Sulfur-type antioxidant (A) . . . Laurylstearyl thiodipropionate.

Sulfur-type antioxidant (B) . . . 5-(3,5-Di-tert-butyl-4-hydroxybenzyl)alkyl thioglycolate.

Sulfur-type antioxidant (C) . . . 4,4'-Thiobis-(6-alkyl-3-methylphenol).

Sulfur-type antioxidant (D) . . . Tetraalkylthiram disulfide

Surfactant (a) . . . Polyoxyethylene nonylphenyl ether (molar number of added ethylene oxide, n=6).

Surfactant (b) . . . Polyoxyethylene lauryl ether (molar number of added ethylene oxide, n=5).

Surfactant (c) . . . Polyoxyethylene monostearate (molar number of added ethylene oxide, n=7).

Extreme-pressure additive of the phosphoric ester type: . . . Tricresyl phosphate.

II. Tested properties and testing methods:

(1) Lubricity:

Using a Timken wear testing machine, a rolling mill oil emulsion having a concentration of 5% and a temperature of 50° C. was beforehand prepared in its tank and was then supplied while recirculating same. The evaluation was performed in accordance with the size of an area (OK area) defined by a galling limit line which extends between a load right before development of galling and its corresponding revolution number. OK areas of the samples are represented by their ratios to the area of the most inferior sample, supposing that the latter area is 1.0.

(2) Annealing stain resistance:

Deteriorating conditions and annealing conditions for coolants with rolling mill oils contained therein:

A coolant (temperature: 60° C.) containing a rolling mill oil at a concentration of 5 wt. % and iron powder (particle sizes: 5 μm and smaller) at a content of 0.3 wt. % was beforehand prepared in a tank. The coolant was then continuously jetted at a pressure of 1.0 kg/cm$^2$ by a gear pump against an iron-made roll which had been heated to 150° C. while recirculating the coolant. Forty eight (48) hours later, the emulsion was spray-coated (0.5 l/min., 1 kg/cm$^2$, for 2 seconds) on the surfaces of steel sheet samples (100 mm long, 100 mm width and 0.5 mm thick). The steel sheet samples were superposed in pairs and were then pressed under 40 kg/cm$^2$ to bring them into close contact. Thereafter, the superposed steel sheet samples were heated at 130° C. for 15 hours in air. Under annealing conditions (A), the samples were annealed at 700° C. for 2 hours in an annealing furnace the atmosphere of which was a mixed gas of 95% nitrogen gas and 5% hydrogen gas. The degree of beautiness of the entire surfaces of each steel sheet was visually evaluated. The degree of beautiness was evaluated in five ranks. Five (5) was allotted to the most inferior sample. Under annealing conditions (B) on the other hand, there was prepared a mixed gas atmosphere of 78% nitrogen gas, 7% carbon monoxide, 4% carbon dioxide gas and 11% hydrogen gas. The samples were annealed at 700° C. for 4 hours in an annealing furnace which tended to induce edge carbon. Thereafter, occurrence of edge carbon at edge portions of each steel plate was visually determined. The degree of occurrence was evaluated in five ranks and five (5) was allotted to the sample with the highest degree of occurrence.

TABLE 1

| No. of rolling mill oil | | Evaluation points on lubricity |
|---|---|---|
| Rolling mill oil of this invention | 1 | 2.15 |
| | 2 | 2.25 |
| | 3 | 2.50 |
| | 4 | 2.60 |
| | 5 | 2.55 |
| Comparative rolling mill oil | 1 | 1.45 |
| | 2 | 1.50 |
| | 3 | 2.05 |
| | 4 | 1.60 |
| | 5 | 1.81 |
| | 6 | 1.87 |
| | 7 | 1.00 |

TABLE 2

| No. of rolling mill oil | | Evaluation points | |
|---|---|---|---|
| | | Annealing conditions (A) | Annealing conditions (B) |
| Rolling mill oil of this invention | 1 | 1–2 | 1 |
| | 2 | 1–2 | 1 |
| | 3 | 1 | 1 |
| | 4 | 1 | 1–2 |
| | 5 | 1 | 1 |
| Comparative rolling mill oil | 1 | 2–3 | 3–4 |
| | 2 | 2–3 | 2–3 |
| | 3 | 2–3 | 3–4 |
| | 4 | 2 | 3–4 |
| | 5 | 4–5 | 5 |
| | 6 | 5 | 5 |
| | 7 | 2–3 | 3 |

As apparent from Table 1 and Table 2, the cold-rolling lube oils of this invention were superior in both lubricity and annealing stain resistance to the comparative rolling mill oils.

Having now fully described the invention, it will be apparent to one of ordinary skill in the art that many changes and modifications can be made thereto without departing from the spirit or scope of the invention as set forth herein.

What is claimed is:

1. A water emulsifiable cold-rolling lube oil for metallic materials comprising:

(a) 40–90 wt. % of a monoester of an aliphatic carboxylic acid having 12–22 carbon atoms and an aliphatic alcohol having 1–12 carbon atoms;

(b) 0.5–10 wt. % of at least one of dimer acids and polymer acids of unsaturated higher fatty acids having 16–20 carbon atoms;

(c) 10–25 wt. % of a fat or fatty oil, or 5–70 wt. % of an ester having a molecular weight of 750–7500 which is obtained by reacting the remaining carboxyl or hydroxyl groups or a polyester, which in turn is obtained by heating and condensing at least one dimer acid or polymer acid of an unsaturated higher fatty acid having 16–20 carbon atoms and a polyol, with an alcohol having 1–22 carbon atoms or a fatty acid having 12–22 carbon atoms;

(d) 0.3–10 wt. % of a phenolic antioxidant; and (e) 0.3–10 wt. % of a sulfur containing antioxidant.

2. The lube oil of claim 1, wherein said monoester component (a) is a member selected from the group consisting of methyl stearate, methyl behenate, butyl stearate, octyl stearate, lauryl stearate, methyl oleate, octyl oleate, decyl oleate, lauryl oleate, methyl palmitate, butyl palmitate, the methyl ester of beef tallow fatty acid, the octyl ester of beef tallow fatty acid, the lauryl ester of beef tallow fatty acid, the methyl ester of palm kernel oil fatty acid, the octyl ester of palm kernel oil fatty acid, the octyl ester of coconut oil fatty acid and the lauryl ester of coconut oil fatty acid.

3. The lube oil of claim 1, wherein the acid monomer of said dimer acid or polymer acid component (b) is a member selected from the group consisting of zoomaric acid, oleic acid, linoleic acid and gadoleic acid.

4. The lube oil of claim 1, wherein said fat or fatty oil component of component (c) is beef tallow, palm kernel oil or hog fat.

5. The lube oil of claim 1, wherein the polyol reactant of component (c) is propylene glycol, ethylene glycol, dipropylene glycol, diethylene glycol, neopentyl glycol, butane diol, pentane diol, hexane diol, polyoxypropylene glycol, polyoxyethylene glycol, or polyoxypropylene-polyoxyethylene glycol.

6. The lube oil of claim 1, wherein said $C_{L22}$ alcohol reactant of component (c) is methanol, ethanol, butanol, heptyl alcohol, octyl alcohol, capryl alcohol, nonyl alcohol, decyl alcohol, stearyl alcohol, undecyl alcohol, lauryl alcohol, myristyl alcohol, palmityl alcohol, isostearyl alcohol, behenyl alcohol or oleyl alcohol.

7. The lube oil of claim 1, wherein said phenolic antioxidant is 2,6-di-tert-butyl-p-cresol, 2-tert-butyl-p-cresol, 2,6-di-tert-butylphenol, 3-methyl-6-tert-butylphenol, 2,4-di-tert-butylphenol, 2,5-di-tert-butyl-p-cresol, 3,5-di-tert-butyl-4-hydroxylbenzyl-alcohol, 2,4,6-tri-tert-butylphenol, catechol, p-tert-butyl-catechol, 4,6-di-tert-butyl-resorcin, 6-(4-oxy)-3,5-di-tert-butyl-anilino-2,4-bis-(n-octylthio)-1,3,5-triazine, (4-oxy-3,5-di-tert-butyl-benzyl)-octadecyl phosphate, 4,4'-thiobis(3-methyl-6-tert-butylphenol), 4,4'-butylidenebis(3-methyl-6-tert-butylphenol), 2,2'-methylenebis(4-methyl-6-tert-butylphenol), 2,2'-thiobis(4,6-di-tert-butylresorcin), 2,2'-methylenebis(4-ethyl-6-tert-butylphenol), 4,4'-methylenebis(2,6-di-tert-butylphenol), 2,2'-(3,5-di-tert-butyl-4-hydroxy)propane, 4,4'-cyclohexylidenebis(2,6-di-tert-butylphenol), tetrakis[methylene-3-(3,5-di-tert-butyl-4-hydroxyphenyl)propionate]methane, hexamethyleneglycol-bis[$\beta$-(3,5-di-tert-butyl-4-hydrpxyphenol)-propionate], 2,2'-thio-[diethyl-bis-3-(3,5-di-tert-butyl-4-hydroxyphenol)propionate], 1,3,5-trimethyl-2,4,6-tris(3,5-di-tert-butyl-4-hydroxybenzyl)-benzene, glycol bis-[3,3'-bis-(4'-hydroxy-3'-tert-butylphenyl)butyrate], or 1,3,5,-tris-(4-tert-butyl-3-hydroxy-2,6dimethylbenzyl)isocyanuric acid.

8. The lube oil of claim 1, wherein said sulfur containing antioxidant is dilauryl thiodipropionate, dimyristyl thiodipropionate, distearyl thiodipropionate, laurylstearyl thiodipropionate, distearyl, $\beta,\beta'$-thiodibutylate, dilauryl sulfide, dioctadecyl sulfide, 2-mercaptobenzoimidazole, s-(3,5-di-tert-butyl-4-hydroxybenzyl) alkylthioglycolates, 4,4'-thiobis-(6-alkyl-3-methylphenols), N-oxydiethylne-benzothiazylsulfenamide, tetraalkylthiuram disulfide, or tetraalkylthiuram monosulfide.

9. The lube oil of claim 1, wherein said composition further comprises a surfactant, rust preventive, and an extreme-pressure additive.

10. The lube oil of claim 9, wherein said surfactant is a nonionic surfactant selected from the group consisting of polyoxyethylene alkyl phenyl ether, polyoxyethylene alkyl ether, polyoxyethylene alkyl ester, a polyoxyethylene-polyoxypropylene ether and an alkyl ester of sorbitan, or a phosphoric ester surfactant.

11. The lube oil of claim 9, wherein said surfactant, rust preventive and extreme-pressure additive are present in said composition in amounts of 0.5–5%, 0.1–5% and 0.5–5% respectively.

* * * * *